US006890269B2

(12) United States Patent
Burrows

(10) Patent No.: US 6,890,269 B2
(45) Date of Patent: May 10, 2005

(54) TEMPORARY GOLF CLUB SHAFT-COMPONENT CONNECTION

(75) Inventor: Bruce D. Burrows, Valencia, CA (US)

(73) Assignee: Burrows Golf, LLC, Valencia, CA (US)

( * ) Notice: Subject to any disclaimer, the term of this patent is extended or adjusted under 35 U.S.C. 154(b) by 0 days.

(21) Appl. No.: 10/623,053

(22) Filed: Jul. 17, 2003

(65) Prior Publication Data

US 2004/0018887 A1 Jan. 29, 2004

Related U.S. Application Data

(60) Provisional application No. 60/438,254, filed on Jan. 2, 2003, provisional application No. 60/438,040, filed on Jan. 2, 2003, provisional application No. 60/467,109, filed on Apr. 30, 2003, and provisional application No. 60/398,548, filed on Jul. 24, 2002.

(51) Int. Cl.[7] ..... A63B 53/02

(52) U.S. Cl. ..... 473/307; 473/309; 473/315

(58) Field of Search ..... 473/248, 288, 473/299, 306, 307, 312, 309, 310, 311, 315, 296, 298

(56) References Cited

U.S. PATENT DOCUMENTS

| | | | | |
|---|---|---|---|---|
| 1,266,529 | A | | 5/1918 | Mattem |
| 1,792,852 | A | | 12/1926 | Mattem |
| 1,850,843 | A | | 3/1932 | Lagerblade |
| 2,067,556 | A | | 1/1937 | Wettlaufer |
| 2,464,850 | A | | 3/1949 | Crawshaw |
| 3,524,646 | A | | 8/1970 | Wheeler |
| 3,656,366 | A | * | 4/1972 | Somero ..... 74/492 |
| 3,848,737 | A | | 11/1974 | Kenon |
| 3,891,212 | A | | 6/1975 | Hill |
| 4,253,666 | A | | 3/1981 | Murphy |
| 4,340,227 | A | | 7/1982 | Dopkowski |
| 4,664,382 | A | | 5/1987 | Palmer et al. |
| 4,948,132 | A | | 8/1990 | Wharton |
| 4,984,794 | A | | 1/1991 | Pernelle et al. |
| 5,232,224 | A | | 8/1993 | Zeider |
| 5,275,408 | A | | 1/1994 | Desbiolles et al. |
| 5,433,442 | A | | 7/1995 | Walker |
| 5,577,726 | A | | 11/1996 | Fenton |
| 5,588,921 | A | * | 12/1996 | Parsick ..... 473/299 |
| 5,626,528 | A | | 5/1997 | Toulon |
| 5,839,973 | A | | 11/1998 | Jackson |
| 5,851,155 | A | | 12/1998 | Wood et al. |
| 5,855,526 | A | | 1/1999 | Honma |
| 5,906,549 | A | | 5/1999 | Kubica |
| 6,095,929 | A | | 8/2000 | Clark |
| 6,149,533 | A | | 11/2000 | Finn |
| 6,203,443 | B1 | | 3/2001 | Britton |
| 6,251,028 | B1 | | 6/2001 | Jackson |
| 6,270,425 | B1 | | 8/2001 | Dyer |
| 6,273,828 | B1 | | 8/2001 | Wood et al. |
| 6,287,215 | B1 | | 9/2001 | Fisher |
| 6,319,146 | B1 | | 11/2001 | Mills |
| 6,368,230 | B1 | | 4/2002 | Helmstetter et al. |
| 2002/0037773 | A1 | | 3/2002 | Wood et al. |

* cited by examiner

*Primary Examiner*—Stephen Blau
(74) *Attorney, Agent, or Firm*—Kelly Lowry & Kelley, LLP

(57) ABSTRACT

A temporary shaft-component connection for assembling a selected golf club shaft with a club head and/or hand grip segment, to facilitate custom club design and fitting to suit the needs and preferences of an individual golfer. The temporary shaft-component connection is particularly designed for use with nonmetallic club shafts formed from a graphite-based composite material or the like having a range of different lengths and stiffness (whip) characteristics. The temporary connection includes an adapter insert for slide-fit reception into an adapter socket, wherein the adapter insert and socket include interengaging flat surfaces such as splines to prevent relative rotation therebetween. The adapter insert is mechanically seated and secured relative to the adapter socket at a pair of axially spaced locations, with a resilient compressible anchor member disposed at one of these securement points for substantially eliminating undesired intercomponent movement.

28 Claims, 9 Drawing Sheets

FIG. 5
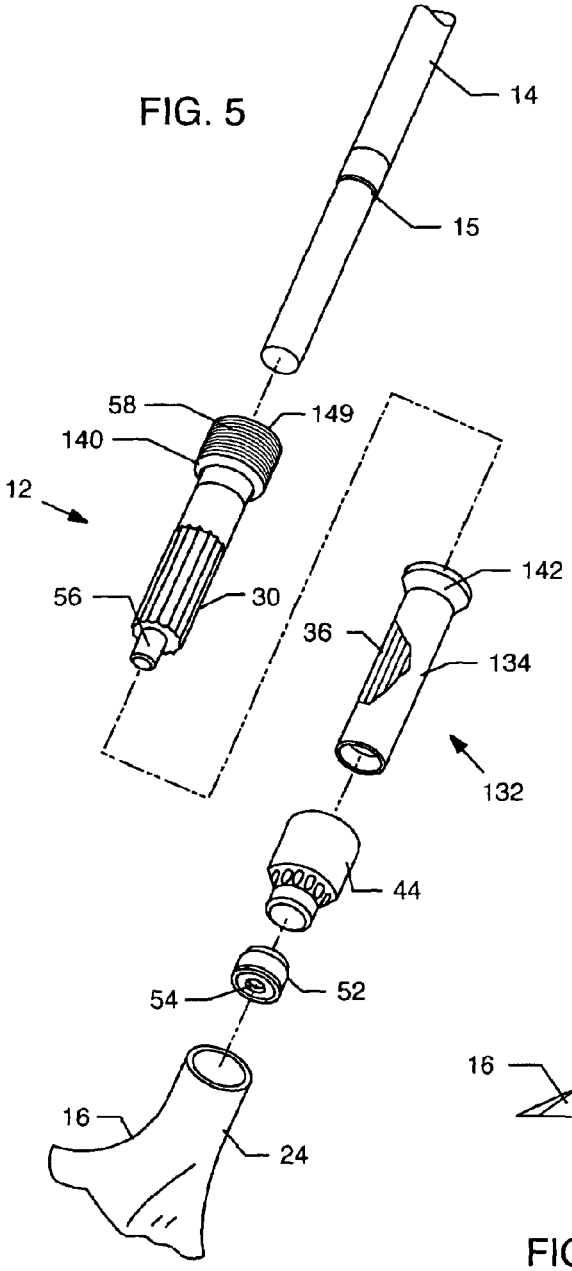
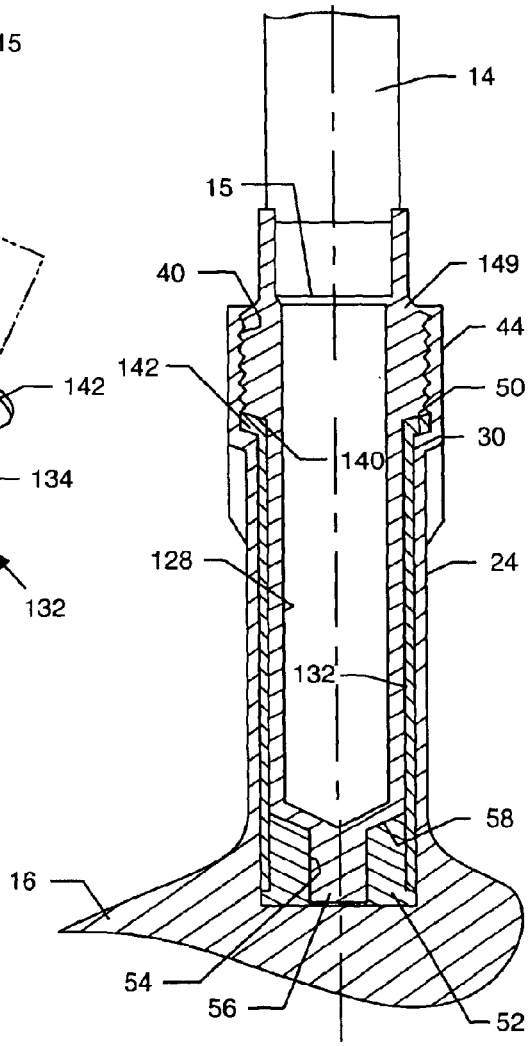
FIG. 6

TEMPORARY GOLF CLUB SHAFT-COMPONENT CONNECTION

This application claims the benefit of U.S. Provisional Application 60/398,548, filed Jul. 24, 2002, U.S. Provisional Application 60/438,254, filed Jan. 2, 2003, U.S. Provisional Application 60/438,040, filed Jan. 2, 2003, and U.S. Provisional Application 60/467,109, filed Apr. 30, 2003.

BACKGROUND OF THE INVENTION

This invention relates generally to improvements in golf clubs. More particularly, this invention relates to an improved temporary connection between a golf club shaft and an additional club component such as a club head and/or a hand grip segment to facilitate customized golf club construction to suit the needs and preferences of an individual golfer. With this construction, multiple club heads and/or multiple hand grip segments can be assembled with one or more golf club shafts, wherein these components may exhibit different characteristics for golfer sampling and testing in the course of actual playing conditions. Accordingly, customized golf club construction to suit the needs and preferences of an individual golfer is facilitated.

Golf clubs are well known in the art, to include a club head such as a wood-type or iron-type club head mounted at a lower end of an elongated club shaft. An upper end of the club shaft has a resilient grip mounted thereon and designed for comfortable manual grasping and swinging of the golf club to strike a golf ball. In modern golf clubs, the wood-type or iron-type club head is commonly formed from a cast or forged metal or metal alloy such as stainless steel, titanium alloy, and the like. The club shaft has historically been formed from a selected metal or metal alloy, while more recent golf club designs have incorporated a nonmetallic club shaft formed from a composite material such as a graphite-based composite or the like. One advantage provided by such graphite-based composite club shaft materials is that the stiffness or flexibility (whip) characteristics of the club shaft can be variably selected in accordance with the preferences and skill level of an individual golfer. That is, by providing a golfer with a selection of club shafts having a range of different whip characteristics, the golfer can custom-tailor his or her set of golf clubs.

In the past, custom fitting of golf clubs having different physical characteristics, such as different club shaft stiffness and lengths, has required a golf shop to carry a large number of sample clubs for test use by golfers. More specifically, for each golf club head, it has been necessary for the golf shop to carry multiple sample club heads of each particular brand and type, each connected to a club shaft having different physical characteristics, for test use by golfers. For example, for any particular driver or other wood-type club head brand, or for any particular iron-type or putter club head brand, it has been necessary for the golf shop to carry a relatively large number of different sample clubs in order to provide a meaningful choice for custom-fitting of each golf club in accordance with the preferences of any one golfer. Accordingly, it has not been possible for a golfer to sample and test a large number of different club shaft-head combinations, without requiring the golf shop to carry an unduly large number of sample clubs. As a result, custom-fitting of golf clubs to an individual golfer generally has not provided the golfer with a truly broad selection of shaft-head combinations, and thus has not provided the golfer with an optimal choice for custom tailored clubs.

Heretofore, a practical and feasible interconnection has not been available to permit multiple club shafts and multiple club heads to be interchangeably mounted quickly and easily, and in a manner permitting test usage of the assembled club by an individual golfer during actual playing conditions. In this regard, prior concepts for interchangeably mounting golf club shafts and club heads have utilized threaded bolts or thread-on mounting arrangements which have exhibited undesired degrees of movement between the assembled components, particularly when those components are subjected to the high impact and shock forces encountered upon normal club use to strike a golf ball.

The resilient hand grip mounted on the upper end of a typical club shaft also comprises a variable in the design and custom fitting of golf clubs to suit the needs and preferences of an individual golfer. That is, resilient hand grips are available in a relatively broad range of different diametric sizes, tread patterns, and elastomer or other soft and compliant materials. The choice of hand grip size is dependent at least in part upon the size of the golfer's hands, with a larger grip diameter being normally preferred by a golfer having larger hands. Hand grip tread pattern and/or the softness or tackiness of the hand grip material may vary significantly in accordance with individual golfer preferences.

The present invention relates to an improved and versatile golf club custom fitting system and method utilizing a temporary connection for secure and stable mounting of a golf club shaft with at least one additional club component such as a club head and/or a hand grip segment, thereby permitting quick and easy temporary assembly of any one of a wide range of shaft-component combinations, so that an individual golfer can be provided with an extensive range of shaft-component combinations for test usage during actual playing conditions in the course of custom fitting of a set of golf clubs, without requiring a golf shop to carry an extremely large number of different sample golf clubs for test use. When the individual golfer decides upon a particular shaft-component combination for any specific golf club, the golf club can then be manufactured with the selected club head connection permanently to the club shaft, and with the selected hand grip, etc.

SUMMARY OF THE INVENTION

In accordance with the invention, a temporary shaft-component connection and related system and method are provided for customized selection and fitting of golf clubs to suit the needs and preferences of an individual golfer, wherein the temporary shaft-component connection is provided for quickly and easily assembling a selected golf club shaft with a selected golf club component such as a club head and/or hand grip segment. This temporary shaft-component connection permits and facilitates construction of a customized golf club having a shaft, club head, and/or hand grip segment each selected from a range of different choices, wherein the assembled golf club can be used and tested by the individual golfer during actual playing conditions, if desired. When the golfer makes a final choice for each of the multiple club components, a customized golf club can be manufactured with conventional permanently connected components.

In general, the temporary shaft-component connection comprises an adapter insert for slide-fit reception into an adapter socket, wherein the adapter insert and socket include interengaging flat surfaces such as splines to minimize or limit relative rotation therebetween. The adapter insert is mechanically seated and secured relative to the adapter socket at a pair of axially spaced locations, with a resilient compressible anchor member disposed at one or both of these securement points for substantially eliminating undesired intercomponent movement.

In the preferred form, the temporary shaft-component connection comprises the adapter insert having a generally sleeve-shaped configuration and formed from a reinforcing material such as a selected metal or the like for mounting by means of epoxy or the like onto an end of the club shaft, particularly such as a nonmetallic club shaft formed from a graphite-based composite material or the like having a range of different lengths and stiffness (whip) characteristics. This adapter insert has an elongated length, and has a size and shape for axial slide-fit reception into the generally matingly shaped adapter socket on the golf club component such as a club head or hand grip segment to be connected thereto. The interengaging flats or splines on the adapter insert and socket prevent significant relative rotation therebetween. In a preferred form, the adapter socket comprises a tubular socket member mounted onto the adjacent component, as by seated reception into a club head hosel, or by seated reception into the open end of a tubular hand grip segment.

The adapter insert includes a radially enlarged thrust flange formed generally at or near a proximal end thereof for seated, bearing engagement against a thrust seat such as an annular surface formed at an open end of the adapter socket. A lock member such as a compression nut is provided for securely interconnecting the adapter insert with the adapter socket, to axially retain the thrust flange in secure seated relation with the socket thrust seat. Alternative lock members members may be used.

The adapter insert further includes a distal end tip or nose for seated and bearing engagement with the resilient anchor member such as a compressible bushing mounted within a base end of the adapter socket. In the preferred form, the nose of the adapter insert and the resilient anchor member include matingly engageable surfaces for at least partially compressing the anchor member when the thrust flange is securely seated and retained on the thrust seat generally at an opposite, open end of the adapter socket.

With this construction, the adapter insert is securely and tightly connected with respect to the adapter socket at two points spaced axially by the substantial length of the adapter insert and socket, preferably at least about 1–2 inches, thereby providing a secure and stable two-point connection that supports the club shaft and interconnected component such as a club head or hand grip segment without significant or detectable wobble or other intercomponent movement or play so that the thus-assembled golf club can be used during normal playing conditions while providing the golfer with a normal solid club feel. The resilient anchor member is sufficiently compressible to accommodate any dimensional tolerance variations between the interconnected components, while providing sufficient structural stiffness and rigidity to substantially eliminate undesirable wobble or other intercomponent movement or play during use of the assembled golf club.

In each embodiment, the club shaft is quickly and easily disassembled from the associated club head and/or hand grip segment by disconnecting a lock member to permit retraction of the adapter insert from the adapter socket. Such disassembly accommodates quick and easy reassembly of the same club shaft with an alternative club head and/or an alternative hand grip segment having different physical characteristics, and/or re-assembly of a different club shaft with the same or different club head and/or hand grip segment components. In this manner, a golfer can test swing and test play a large number of different shaft-head-hand grip segment combinations within a short period of time, for custom fitting of a set of golf clubs, without requiring the golf shop to carry a large number of sample clubs.

Other features and advantages of the present invention will become more apparent from the following detailed description taken in conjunction with the accompanying drawings which illustrate, by way of example, the principles of the invention.

BRIEF DESCRIPTION OF THE DRAWINGS

The accompanying drawings illustrate the invention. In such drawings:

FIG. 5 is a fragmented and exploded perspective view similar to FIG. 3, but showing one alternative preferred form on the invention;

FIG. 6 is an enlarged and fragmented vertical sectional view similar to FIG. 4, and depicting assembly of the embodiment shown in FIG. 5;

DETAILED DESCRIPTION OF THE PREFERRED EMBODIMENTS

Figure 1:
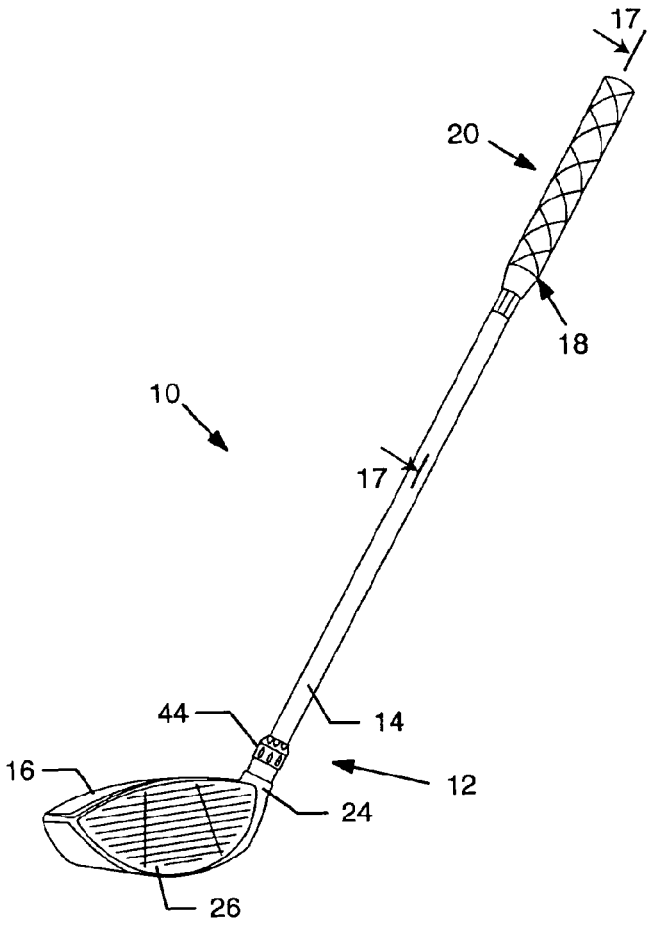
FIG. 1 is a perspective view of a golf club having a golf club shaft connected at a lower end to a wood-type club head by means of the temporary shaft-component connection in accordance with the present invention, and connected at an upper end to a hand grip segment by means of the temporary shaft-component connection in accordance with the present invention.

As shown in the exemplary drawings, a golf club referred to generally in FIG. 1 by the reference numeral 10 is provided with an improved temporary shaft-head connection 12 for quickly and easily interconnecting the lower end of an elongated club shaft 14 with a golf club head 16. In addition, the golf club 10 is provided with an improved temporary connection 18 for quickly and easily connecting the upper end of the elongated club shaft 14 with a hand grip segment 20 having a cushioned or resilient hand grip 22 of selected design carried thereon. These temporary shaft-component connections 12 and 18 permit quick and easy assembly and disassembly of a club shaft 14 having selected design characteristics with a selected club head 16 also having selected design characteristics, and/or with a selected hand grip segment 20 having selected design characteristics, so that a golfer can test swing and test play a relatively large number of different club combinations within a relatively short period of time, and without requiring a golf shop to carry an unduly large number of sample clubs. The temporary shaft-component connections 12 and 18 thus provide a golf club customizing system and method which permits and facilitates custom fitting of a set of golf clubs from a range of different club shafts and/or a range of different club heads and hand grip segments, to suit the needs and preferences of an individual golfer.

Figure 2:
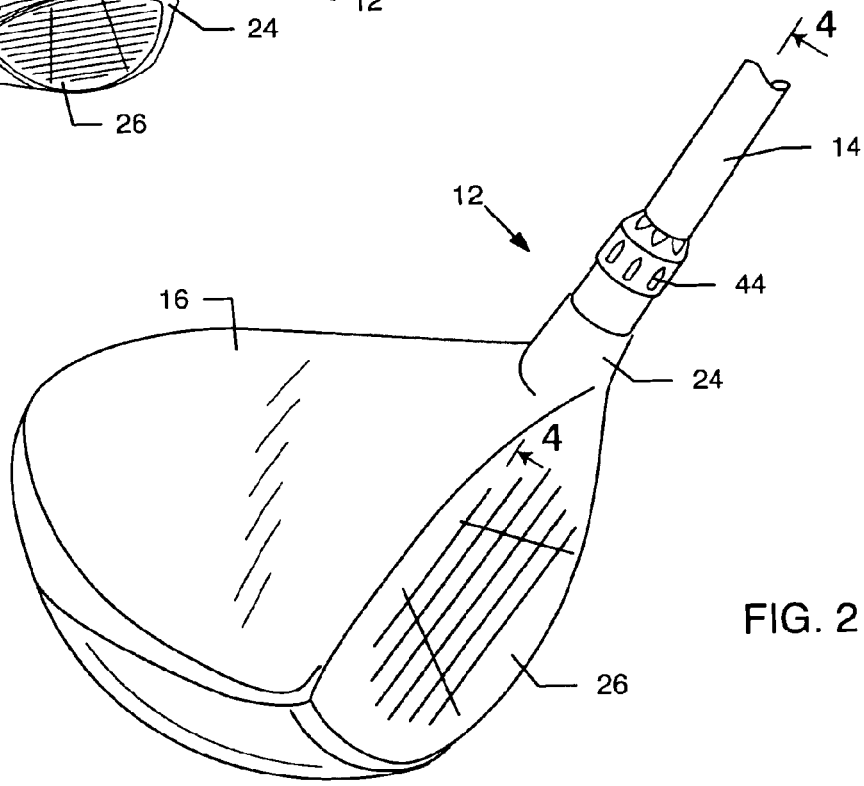
FIG. 2 is an enlarged fragmented perspective view illustrating a lower end of the golf club of FIG. 1.

The illustrative golf club 10 shown in FIG. 1 has an overall, generally conventional construction to include the elongated club shaft 14 connected to the club head 16 by interfitting a lower end of the club shaft 14 with a hosel 24 formed to extend generally upwardly from a heel end of the club head 16. In this regard, FIGS. 1 and 2 show the club head 16 in the form of a wood-type club head having a front ball impact face 26 for striking a golf ball (not shown). In accordance with modern golf club construction, this wood-type head 16 typically comprises a so-called metal wood club head comprising a hollow head construction formed from a selected cast or forged metal or alloy such as stainless steel, titanium alloy, etc. Alternative club head types such as iron-type club heads, putters, and the like may be used.

The club shaft 14 has an elongated and typically hollow tubular construction extending from a lower end for connection to the club head 16 to an upper end for connection to the hand grip segment 20, as will be described in more detail. In many modern golf clubs, the club shaft 14 is formed from a nonmetallic material such as a carbon or graphite-based composite or the like, commonly referred to as a "graphite" shaft, which can be manufactured within a range of different physical characteristics such as length, and stiffness or flexibility (whip) to suit the needs and preferences of an individual golfer. In this regard, in the course of custom fitting a set of golf clubs to a particular golfer, it is common for the golfer to choose a club shaft 14 having specific and preferred physical characteristics from among a number of different club shafts having different physical characteristics. Similarly, it is common for the golfer to choose a club head 16 from among a number of different club heads exhibiting different physical characteristics such as overall size, weight and weight distribution, head material, etc. In the same fashion, it is common for the golfer to choose a hand grip 22 from among a number of different available hand grips formed, for example, with different diametric sizes, or from different cushioned materials or with different specific tread patterns.

In general terms, the temporary shaft-component connections 12 and 18 of the present invention are provided to permit and facilitate golfer selection of preferred shaft-head and preferred shaft-grip combinations in the course of custom fitting one or more golf clubs to an individual golfer. The temporary connections 12 and 18 designed to enable quick and easy assembly of a specific shaft-head combination, and/or related quick and easy assembly of a specific shaft-grip combination for golfer testing by actual swinging of the assembled club 10 and usage of the club during actual playing conditions, for example, during a normal round of golf. After testing a specific club combination, the assembled club components can be quickly and easily disassembled to accommodate substitution and re-assembly with one or more different components for further test use by the same golfer, or for test use by a different golfer.

Accordingly, with the custom club fitting system and method of the present invention, a golfer can test swing and test play a relatively large number of different shaft-head and shaft-grip combinations within a relatively short period of time, and without requiring a golf shop to carry an extremely large number of different sample clubs. Instead, the golf shop need only carry a single set of club shafts 14 having the range of different physical characteristics, a single set of club heads 16 to include, for example, a range of different so-called wood-type heads and a range of different so-called iron-type heads, and one or more putter heads, etc. In addition, the golf shop need only carry a plurality hand grip segments 20 having a range of different hand grips 22 mounted respectively thereon. When the individual golfer arrives at a preferred set of club characteristics, after appropriate component testing for a given golf club type, for example, a driver, a custom-fitted golf club exhibiting that preferred set of characteristics can be assembled with a conventional permanent shaft-head connection and the selected hand grip mounted onto the shaft. Importantly, however, during testing, the assembled test club with the temporary shaft-component connections 12 and/or 18 can be used during actual playing conditions to provide the "feel" and playability of an as-manufactured custom-fitted club, substantially without any significant or detectable undesired wobble or movement between the assembled golf club components.

Figure 3:
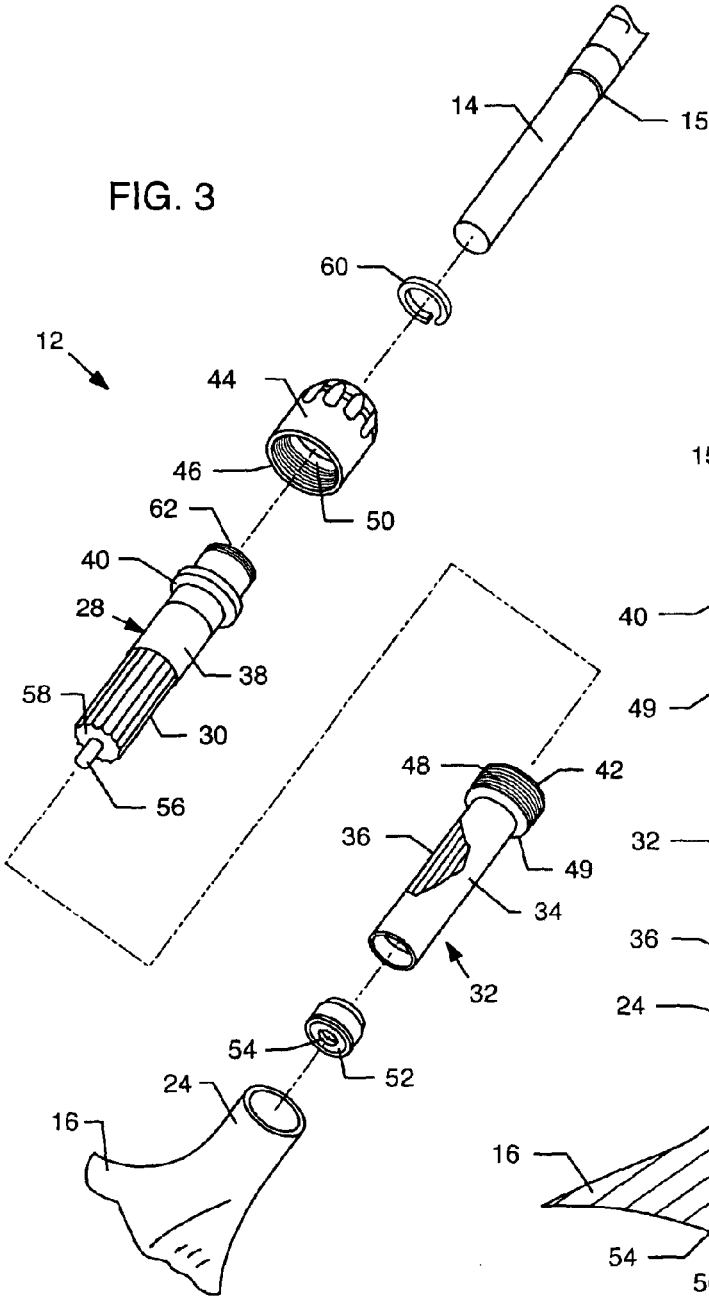
FIG. 3 is a fragmented and exploded perspective view showing the temporary shaft-component connection for assembling a golf club head to a lower end of the golf club shaft.
Figure 4:
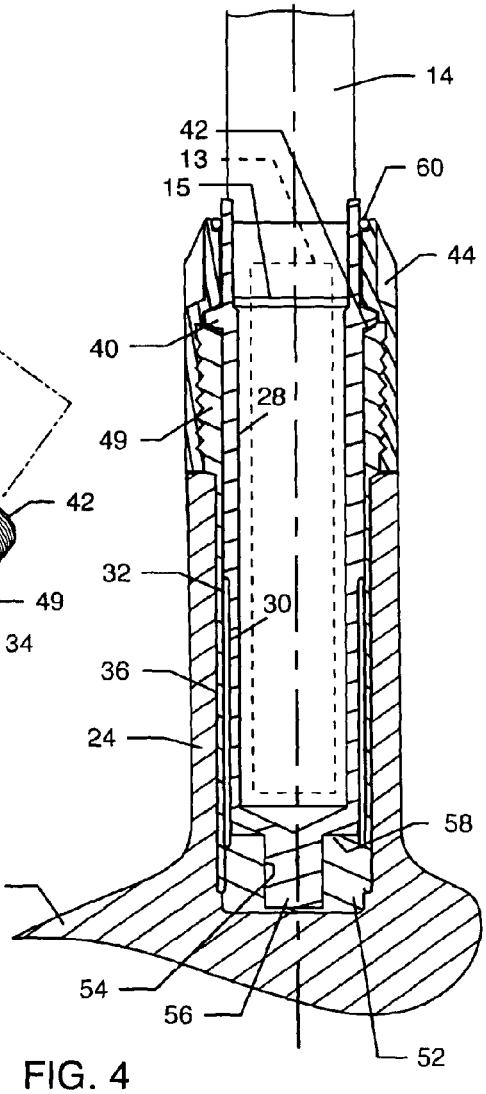
FIG. 4 is an enlarged and fragmented vertical sectional view taken generally on the line 4—4 of FIG. 2.

The temporary shaft-head connection 12 is shown in more detail, in accordance with one preferred form of the invention in FIGS. 2–4. As shown, the lower end of the club shaft 14 such as a graphite shaft has a generally round cross sectional shape and is slide-fit received into the open upper end of a sleeve-shaped adapter insert 28. The club shaft 14 may include a chamfered step 15 to define a slightly reduced diameter distal end for facilitated slide-fit reception into the adapter insert 28. This adapter insert 28 is formed from a suitable rigid or sturdy bearing material, preferably a metal material such as aluminum, stainless steel, titanium or titanium alloy, or the like, and is securely affixed onto the lower end of the shaft 14 by means of a conventional epoxy or other suitable adhesive connection or the like. Where the club shaft 14 is formed with a cylindrical or tubular configuration, a reinforcement plug 13 (shown in dotted lines in FIG. 4) may be press-fit or adhesive mounted therein to bridge and thereby reinforce the club shaft 14 particularly in the region of the chamfered step 15. This reinforcement plug 13, which may be formed from metal, plastic, or epoxy or the like to have a solid or tubular shape, preferably terminates at a location slightly above the chamfered step 15, but slightly below the assembled connection 12 to avoid interfering with shaft whip characteristics.

The sleeve-shaped adapter insert 28 has a lower external segment 30 defining an external flats or other suitable noncircular cross sectional geometry such as the splined configuration as shown best in FIG. 3. The specific geometry of this lower insert segment 30 is sized and shaped for mating slide-fit and seated reception into an adapter socket 32, shown best in FIGS. 3–4 in the form of a tubular socket member 34 defining internal flats or other matingly shaped and suitable noncircular cross sectional geometry such as the illustrative internal splines 36 (FIG. 3). The adapter socket member 34 is sized and shaped for slide-fit reception into the upwardly open hosel 24 of the club head 16, and is securely affixed therein by means of a conventional epoxy or other suitable adhesive connection or the like. Alternately, persons skilled in the art will recognize and appreciate that the socket member 34 may be formed as an integral portion of the hosel 24, with the internal splines 36 or other flat-surfaced internal geometry formed integrally within the hosel. Importantly, when the adapter insert 28 is axially slide-fit received into the adapter socket 32, the splines 30 and 36 or other suitable matingly interfitting flat surfaces or the like function to lock the adapter insert 28 and club shaft 14 connected thereto against any significant rotation relative to the adapter socket 32 and club head 16 connected thereto.

The illustrative adapter insert 28 further includes an upper, generally cylindrical end segment 38 extending upwardly from the lower splined segment 30, including a radially outwardly projecting thrust flange 40 positioned for secure and stable axial seating onto an annular thrust seat 42 formed at an upper end of the adapter socket 32, when the adapter insert 28 is slide-fit assembled with the adapter socket 32. A lock member shown in the form of a compression nut 44 is slidably fitted over this upper end segment 38 of the adapter insert 28 and includes an internal or female thread 46 for thread-on connection with an external or male thread 48 at an upper end of the adapter socket 32. In this regard, when the adapter socket 32 comprises the socket member 34 mounted into the club head hosel 24, the male thread 48 is formed on a radially enlarged upper shoulder segment 49 having a lower end sized for seating upon an axially upper end of the hosel 24, and an upper end defining the thrust seat 42. Thread-on connection of the compression nut 44 with the socket thread 48 moves an internal thrust shoulder or bearing surface 50 within the nut 44 into axially bearing engagement with the thrust flange 40 on the adapter insert 28, for securely seating and retaining the thrust flange 40 tightly upon the underlying thrust seat 42 on the adapter socket 32.

In addition, a compliant, partially compressible anchor member 52 shown in the form of a cylindrical bushing is positioned at the bottom or base of the adapter socket 32 and is configured for engaging the distal end tip or nose of the adapter insert 28 to provided a second connection point which significantly enhances the structural rigidity and integrity of the interconnected components, particularly for retaining the shaft 14 and club head 16 in interconnected relation without undesired wobble or play between the components. In this regard, the bushing 52 is constructed in a preferred form from a material having at least some resilience or compressive capacity, so that the tolerance variations can be accommodated to provide tight retention of the adapter insert 28 at two axially spaced points, namely, at the thrust flange 40 and at the point of engagement between the nose of the adapter insert 28 with the bushing 52. At the same time, the bushing 52 exhibits sufficient structural rigidity to maintain a tight and substantially wobble-free interconnection. In one preferred form, the anchor member or bushing 52 is formed from a molded urethane plastic. In a preferred configuration, the engagement point between the nose of the adapter insert 28 with the bushing 52 is spaced axially by a distance of at least about 1–2inches from the thrust flange 40.

More specifically, as viewed in FIGS. 3–4, the bushing 52 comprises a generally cylindrical component to include a central bore 54 therein. The nose of the adapter insert 28 includes an axially projecting pin 56 having a size and shape for tight slide-fit reception into the bushing bore 54, with said pin 56 projecting axially from an axially presented bearing surface 58 at the end of the adapter insert. When the adapter insert 28 is fully inserted into the adapter socket 32, with the thrust flange 40 tightly retained on the thrust seat 42, the adapter insert tip 56 is tightly seated within the bushing bore 54 and the related bearing surface 58 is tightly engaged axially with an axially mating face on the bushing 52. In the most preferred configuration, the bearing surface 58 on the adapter insert 28 bears against and at least slightly compresses the bushing 52 in this position, thereby providing a stable and secure second point of connection between the adapter insert 28 and the adapter socket 32.

A selected club shaft 14 having a particular set of physical characteristics is thus assembled quickly and easily with a selected club head 16. The adapter insert 28 is rotationally locked relative to the adapter socket 32, and the dual-point connection of the thrust flange 40 and the adapter tip 56 to the adapter socket 32 provides a stable and secure component interconnection without any significant or player-detectable intercomponent wobble or movement despite potentially high forces applied during club swinging and ball impact. After testing, the components can be separated quickly and easily by unthreading the compression nut 44 from the adapter socket 32 to permit retraction of the adapter insert therefrom. In this regard, a backstop or reaction ring 60 such as a snap-ring or the like can be seated within a groove 62 formed on the cylindrical upper end segment 38 of the adapter insert 28, at a location above the thrust flange 40, wherein this ring 60 is axially engaged by the compression nut 44 upon unthreading movement thereof for physically drawing the adapter insert 28 from the adapter socket 32. The particular shaft-head combination can thus be disassembled quickly and easily, followed by quick and easy re-assembly of the club head with an alternative club shaft having different physical characteristics, and/or re-assembly of the club shaft with a different club head.

A variety of modifications and improvements in and to the temporary shaft-head connection 12 as shown in FIGS. 1–4 will be apparent to persons skilled in the art. While some of such modifications and improvements are shown in the accompanying FIGS. 5–17 and will thus be described herein in more detail, it will be recognized and understood that such alternative embodiments are not limiting with respect to the scope of the invention disclosed herein. For example, persons skilled in the art will appreciate that the resilient or compressible connection of the nose of the adapter insert 28 with the base or bottom end of the adapter socket 32 may be accomplished by a variety of different mechanical structures having a range of different, substantially mating interfitting configurations for retaining the nose of the adapter insert against significant axial or radial displacement relative to the adapter socket 32. Similarly, persons skilled in the art will understand that a variety of different lock members and mechanisms may be used for retaining the thrust flange 40 tightly on the thrust seat 42 of the adapter socket 32.

Figure 16:
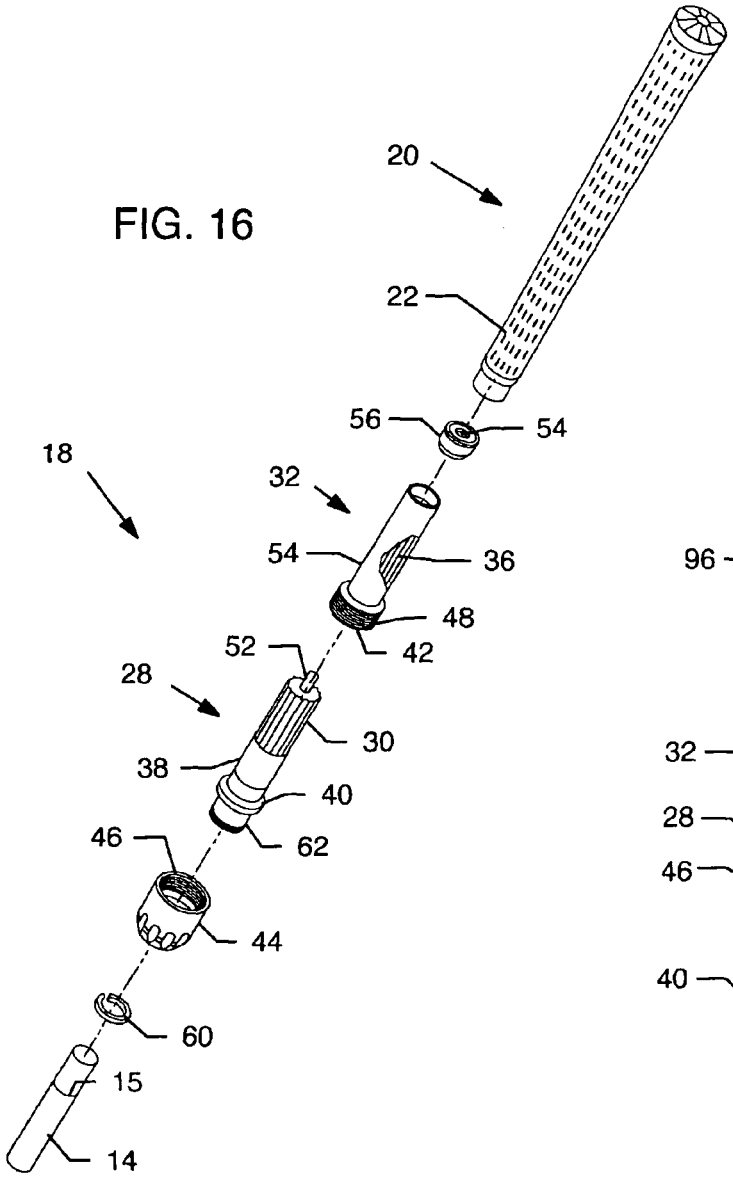
FIG. 16 is a fragmented and exploded perspective view illustrating showing the temporary shaft-component connection for assembling a hand grip segment onto an upper end of the golf club shaft.
Figure 17:
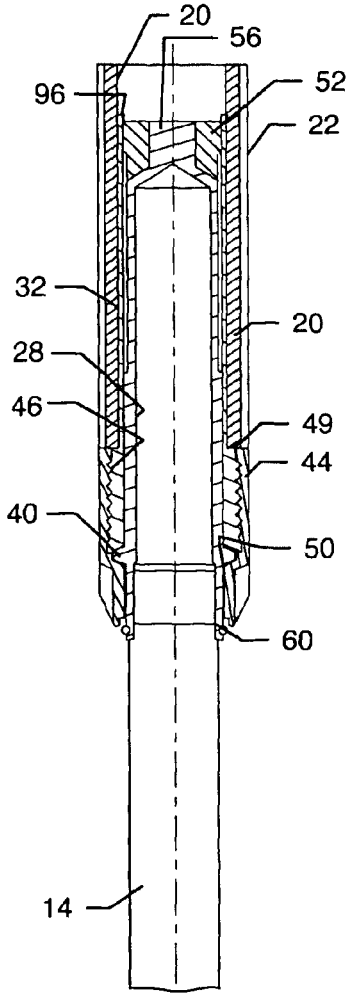
FIG. 17 is an enlarged and fragmented vertical sectional view taken generally on the line 17—17 of FIG. 1.

By way of further specific illustration and example, FIGS. 5–15 generally depict modified shaft-head connections for temporary removable mounting of a golf club head onto a club shaft. In contrast, FIG. 16-17 depict an exemplary temporary connection 18 for coupling an upper end of a club shaft with a hand grip segment 20, wherein the illustrative connection 18 corresponds with the shaft-head connection 12 shown and described in FIGS. 3–4. It will be understood and appreciated, however, that any one of the shaft-head connections shown in FIGS. 1–15 may be employed for use as a shaft-hand grip segment connection. Moreover, it will be recognized that the features of the various disclosed embodiments shown in FIGS. 1–17 are interchangeable to provide the desired two point connection for secure and stable temporary coupling of the club shaft with the adjacent head or hand grip component.

With respect to the shaft-head temporary connection embodiments depicted in FIGS. 5–15, components identical to those shown and described in FIGS. 1–4 are referred to by the same reference numerals, and components which are modified from but otherwise analogous in terms of structure or function to those shown and described in FIGS. 1–4 are referred to by common reference numerals increased by a factor of 100.

FIGS. 5–6 illustrate one alternative preferred form of the invention, wherein the relative positions of the compression nut 44 and the male thread 48 are reversed with respect to the adapter insert and adapter socket. More particularly, as shown, a modified adapter insert 128 is mounted onto a lower end of the club shaft 14, and includes a protruding pin 56 at a distal or nose end thereof together with a lower splined segment 30. This splined segment 30 is configured for slide-fit reception into a modified adapter socket 132 defined by a modified socket member 134 having an internal spline 36 formed therein. The pin 56 at the nose end of the adapter insert 128 is sized and shaped for seated engagement with a resilient anchor member such as the bushing 52, as previously described.

An upper end of the adapter socket 32 is flared radially outwardly to define an upwardly presented thrust seat 142 for secure and stable seated retention of a downwardly presented thrust flange 140 formed on the adapter insert 128. In this embodiment, an upper side of the thrust flange 140 merges with a radially enlarged shoulder segment 149 formed as part of the adapter insert and having the external thread 48 formed thereon. The compression nut 44 is inverted relative to the embodiment of FIGS. 3–4, so that the internal thrust shoulder 50 therein engages an underside of the flared thrust seat 142 as the female thread 46 is rotatably engaged with the male thread 44, causing the thrust flange 140 to be drawn downwardly into tight seated engagement with the thrust flange 142.

Figure 7:
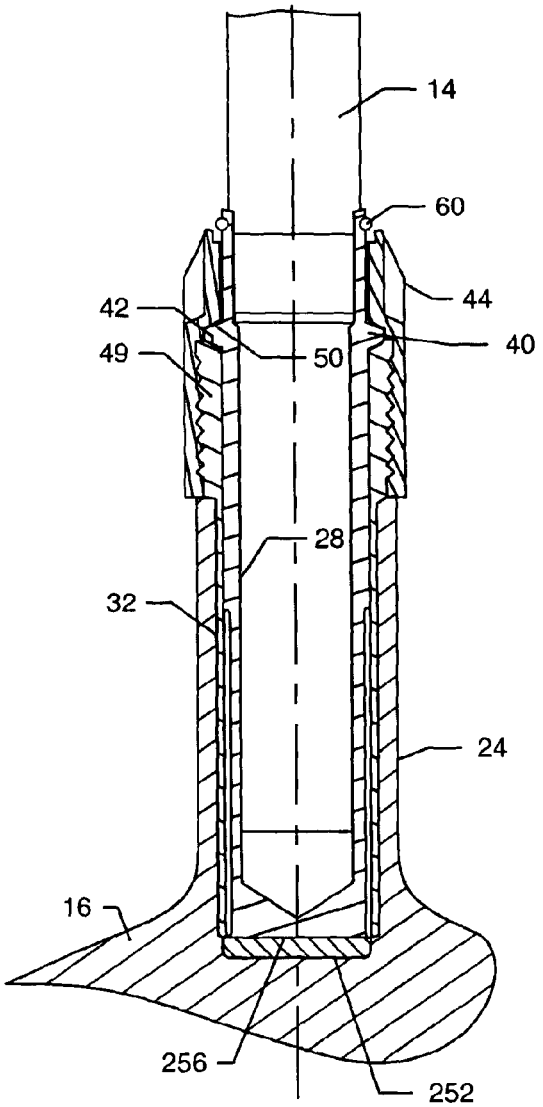
FIG. 7 is an enlarged and fragmented vertical sectional view similar to FIG. 4, and illustrating another alternative preferred form of the invention.

FIG. 7 shows another alternative embodiment corresponding generally with that previously shown in FIGS. 3–4, except that the configuration of the compressible anchor member 52 and the associated nose of the adapter insert 28 are modified. In this version, the distal tip end or nose of the adapter insert 28 incorporates a relatively flat tip 256 for pressed abutting engagement with a modified anchor member 252 in the form of a compliant disk mounted at the bottom or base of the adapter socket 32. When the compression nut 44 is threaded onto the male thread 48 at the upper end of the adapter socket 32, to retain the thrust flange 40 tightly upon the thrust seat 42, the tip 256 of the adapter insert 28 tightly engages and at least partially compresses the disk 252 to substantially eliminate relative movement between the tip 256 and the base of the adapter socket 32. Alternately, in this and other embodiments of the invention, the compliant anchor member may be carried at the nose of the adapter insert for bearing engagement with the base or bottom end of the adapter socket.

Figure 8:
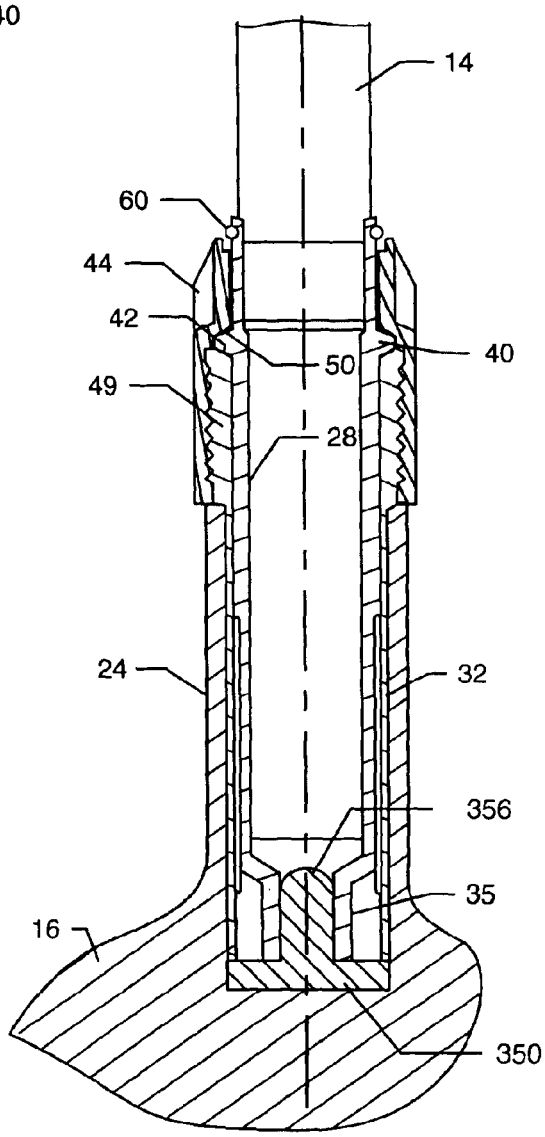
FIG. 8 is an enlarged and fragmented vertical sectional view similar to FIG. 4, and depicting a further alternative preferred form on the invention.

FIG. 8 illustrates a further alternative embodiment corresponding with FIGS. 3–4, except that a different modified configuration is provided for the compressible anchor member and associated nose of the adapter insert. In this concept, the nose of the adapter insert 28 is modified to provide an axially protruding sleeve 354 having a size and shape for tight slide-fit reception of an upstanding pin 356 formed as a portion of a modified anchor member 352 mounted at the bottom or base end of the adapter socket 32. When the adapter insert 28 is received into the adapter socket 32, with the compression nut 44 retaining the thrust flange 40 tightly upon the thrust seat 42, the pin 356 is tightly received into the nose sleeve 354 on the insert 28 for substantially eliminating relative movement between the sleeve 354 and the pin 356.

Figure 10:
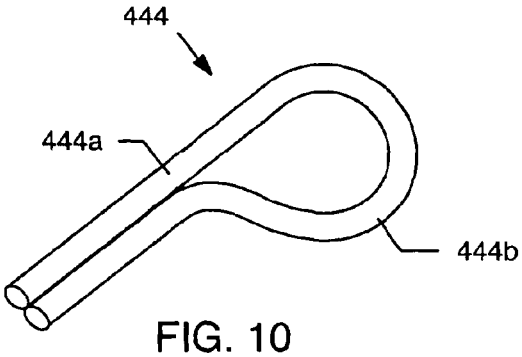
FIG. 10 is a perspective view illustrating a lock clip for use with the embodiment of FIG. 9.
Figure 9:
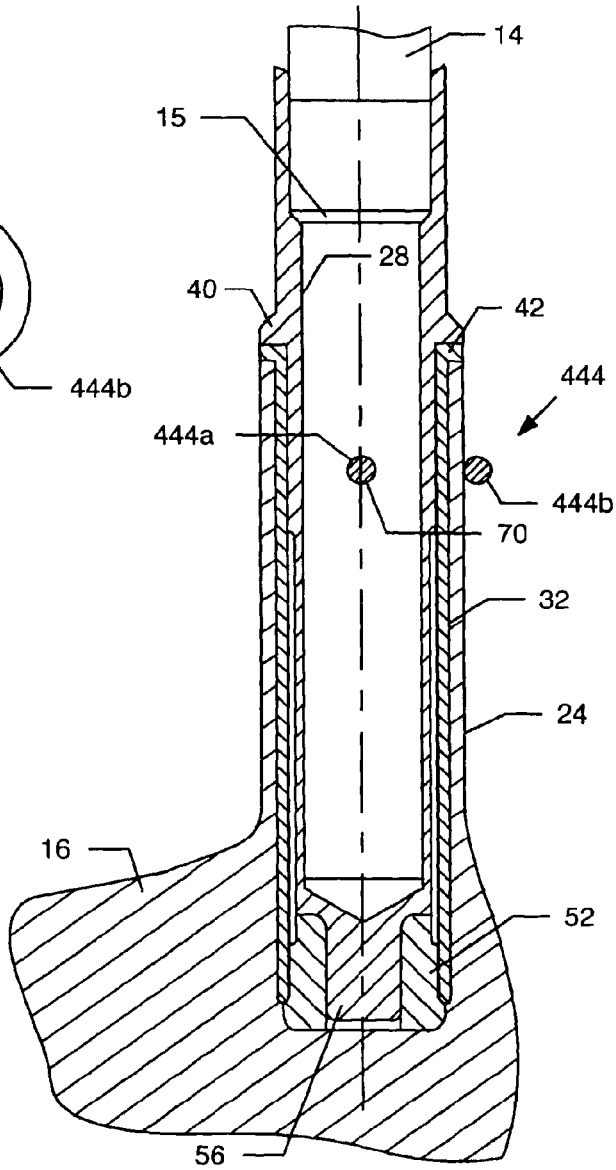
FIG. 9 is an enlarged and fragmented vertical sectional view similar to FIG. 4, and showing still another alternative preferred form of the invention.

FIGS. 9–10 show a modified form of the invention similar to FIGS. 3–4, except that a different lock means is provided for securing the thrust flange 40 of the adapter insert 28 tightly onto the thrust seat 40 of the adapter socket 32. In this version of the invention, the compression nut 44 is omitted in lieu of a lock clip 444. More particularly, as viewed in FIG. 9, the adapter insert 28 and the adapter socket 32 and associated hosel 24 incorporate a diametrically extending lock port 70 formed through these components, when the thrust flange 40 is seated on the thrust seat 42, with the nose pin 56 engaged with the compliant bushing 52. The lock clip 444 such as metal spring clip (FIG. 10) has a first leg 444*a* for slide-fit passage through the lock port 70 to retain the adapter insert 28 in the desired position with the thrust flange 40 retained snugly on the thrust flange 42, and a second leg 444*b* shaped to wrap partially about the hosel 24 to retain the lock clip in place. Manual retraction of the lock clip 444 from the assembled components permits quick and easy disassembly and subsequent quick and easy re-assembly of the shaft 14 with a different club head 16, or vice versa, as previously described. Alternative removable lock clip concepts may be used, such as a generally U-shaped lock clip removably fitted about the hosel 24 and engageable via radially open slots in the hosel and adapter socket for axially locking and retaining the adapter insert in place.

Figure 11:
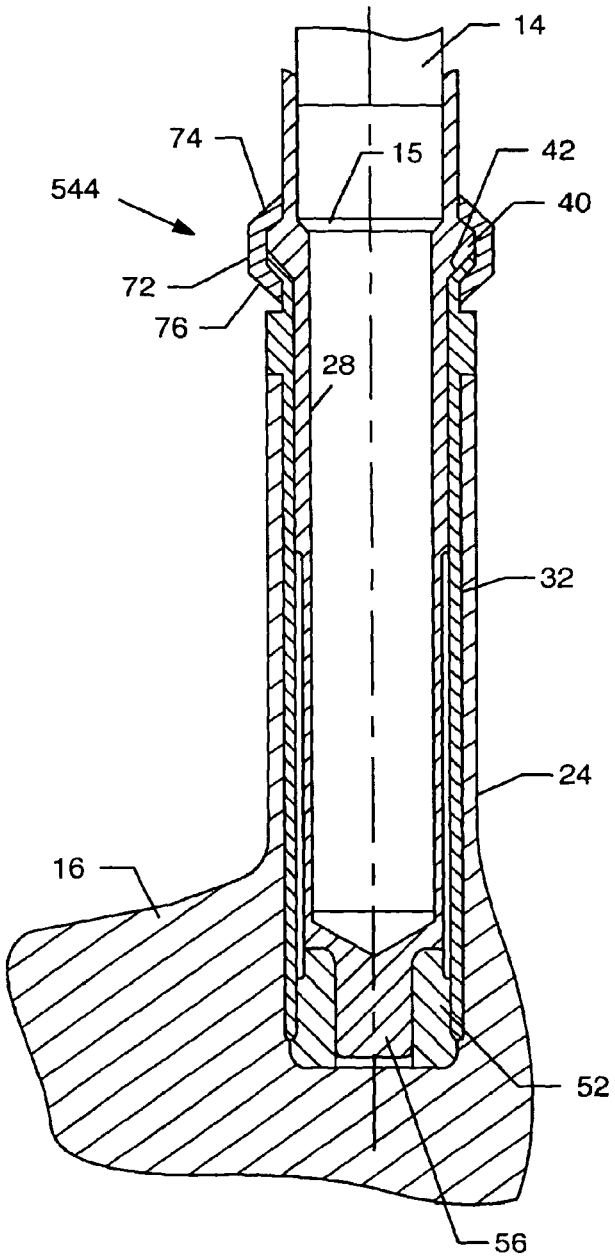
FIG. 11 is an enlarged and fragmented vertical sectional view similar to FIG. 4, and depicting a further alternative preferred form of the invention.
Figure 12:
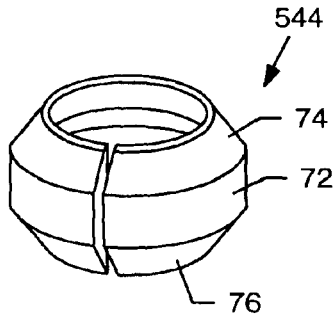
FIG. 12 is a perspective view of a snap ring for use in the embodiment of FIG. 11.

FIGS. 11–12 illustrate another alternative lock means for removably retaining the thrust flange 40 of the adapter insert 28 securely on the thrust flange 42 of the adapter socket 32. In this version, an upper end of the adapter socket 32 is flared radially outwardly to define the upwardly presented thrust seat 42 for seated reception thereon of the thrust flange 40 formed on the adapter insert 28. The compression nut 44 (FIGS. 3–4) is omitted in lieu of a snap ring 544 having a size and shape for snap-fit, substantially clamped engagement with the thrust flange 40 and the thrust seat 42 to retain these structures in axially assembled relation. In this regard, the preferred snap ring 544 comprises a central, generally cylindrical wall 72 having a size for close-fit reception about the periphery of the thrust flange 40, with upper and lower lock wall segments 74 and 76 extending respectively upwardly and radially inwardly, and downwardly and radially inwardly, for axially clamping the thrust flange 40 securely on the thrust seat 42. The snap ring 544 can be snap-fitted or clamped in place as an assembly step, and appropriately removed when component disassembly is desired.

Figure 13:
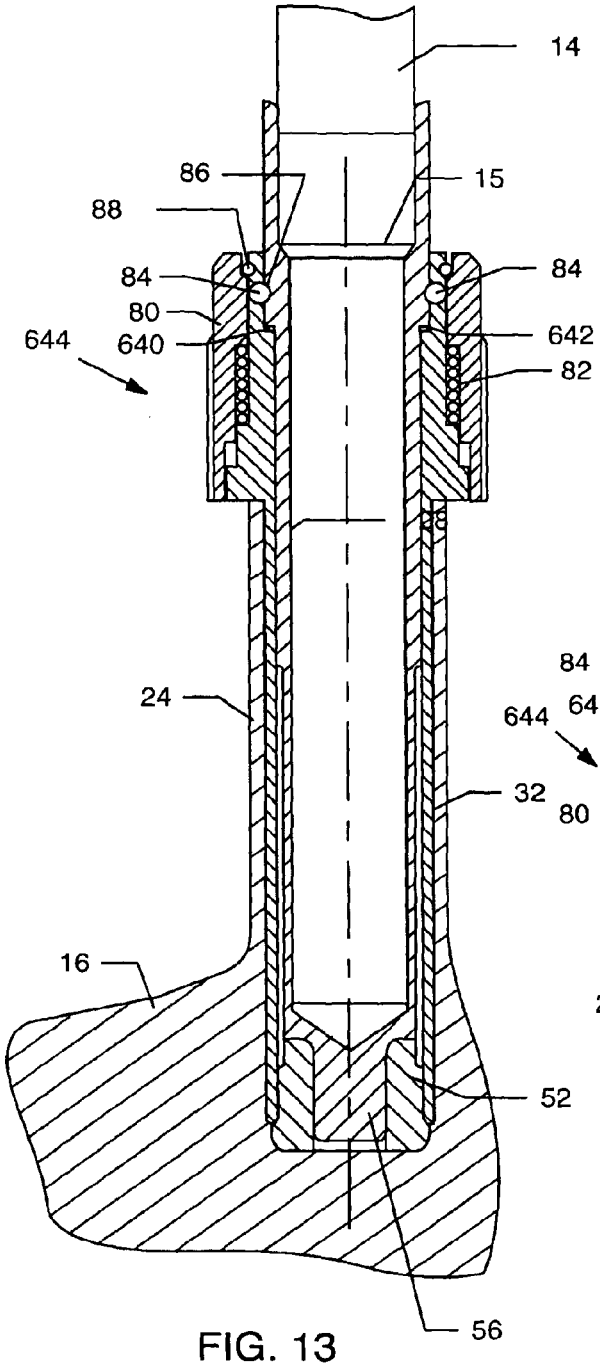
FIG. 13 is an enlarged and fragmented vertical sectional view similar to FIG. 4, and showing still another alternative preferred form on the invention.
Figure 14:
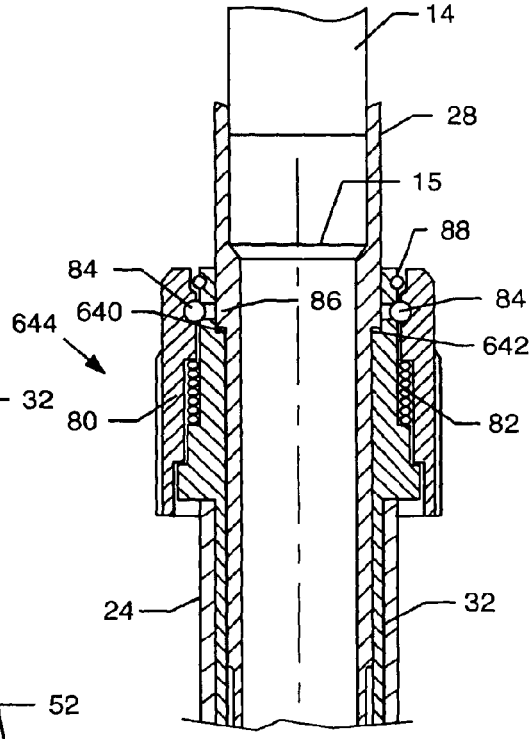
FIG. 14 is a fragmented vertical sectional corresponding to a portion of FIG. 13, and illustrating quick-connect-disconnect lock means in a retracted or unlocked position.

FIGS. 13–14 show still another alternative form of the invention wherein a modified lock means is provided for releasably retaining the thrust flange of the adapter insert 28 upon the thrust seat of the adapter socket 32. In this embodiment, the compression nut 44 of FIGS. 3–4 is omitted in lieu of a quick-connect-disconnect coupling 644.

More particularly, the coupling 644 comprises an axially movable sleeve 80 mounted on the adapter socket 32 and normally biased by a spring 82 toward a normal advanced position urging an array of lock balls 84 toward radially inward positions (FIG. 13) for seating within a circumferential groove 86 formed in the adapter insert 28, to lock and retain a radially expanded thrust flange or shoulder 640 tightly upon an underlying thrust seat 642 formed on the adapter socket 32. Retraction of the coupling sleeve 80 against the spring 82 aligns the lock balls 84 with a surrounding groove 88 formed in the sleeve 80, to accommodate radially outward ball displacement sufficient to permit removal of the adapter insert 28 from the adapter socket 32, and subsequent re-assembly of these components when and if desired.

Figure 15:
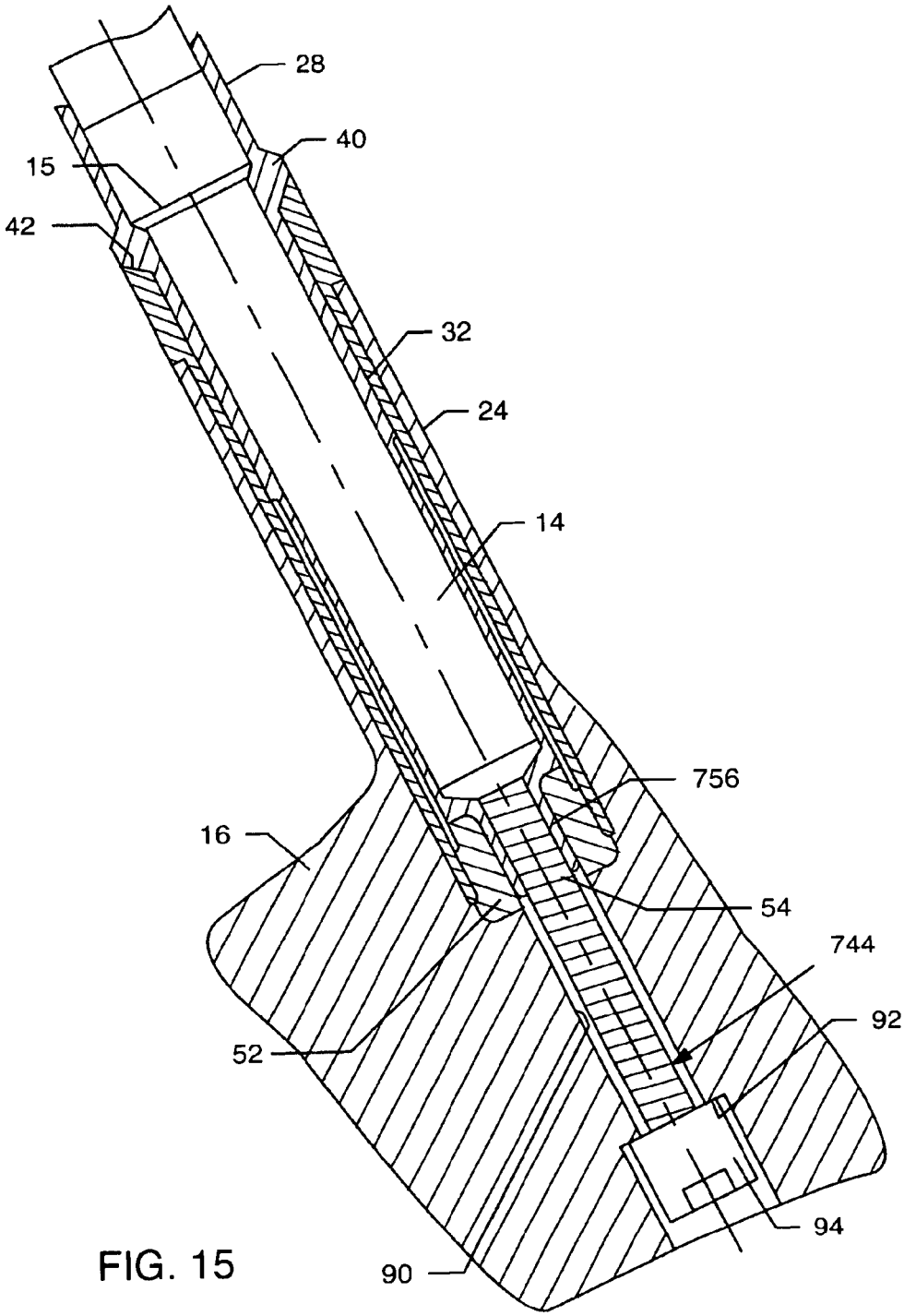
FIG. 15 is a fragmented vertical sectional view similar to FIG. 4, and depicting another alternative preferred form of the invention.

FIG. 15 shows another lock means variation suited particularly for a shaft-head connection, wherein the compression nut 44 of FIGS. 3-4 is omitted in lieu of a lock bolt 744 attached to the adapter insert 28 through a downwardly open bore 90 formed in the club head 16. In this version of the invention, the adapter insert 28 includes the thrust flange 40 for seated retention on the thrust seat 42 at the upper end of the adapter socket 32. In addition, the adapter insert 28 includes a modified protruding nose pin 756 for binding reception to the central bore 54 in the compliant bushing 52 at the bottom or base end of the adapter socket 32. However, the modified nose pin 756 is formed with a generally sleeve-shaped configuration and is internally threaded for engagement with the threaded shank of the lock bolt 744 passed upwardly into the head bore 90. As shown, this bore 90 includes a countersunk outboard or lower end defining a shoulder 92 for engagement by the bolt head 94, as the lock bolt is tightened into the threaded pin 756. The lock bolt 744 thus functions to securely draw and tightly retain the thrust flange 40 on the thrust seat 42, while the pin 756 engages the compliant bushing 52 to provide the second connection point between the adapter insert 28 and socket 32.

FIGS. 16–17 depict one preferred configuration for the temporary connection 18 used to connect the upper end of a selected shaft 14 with a hand grip segment 20 having a selected hand grip 22 mounted thereon. In this regard, as shown in these drawings, a preferred temporary connection 18 utilizes the same components interconnected in the same two-point manner as previously described with respect to FIGS. 1–15, with FIGS. 16–17 illustrating the specific embodiment of FIGS. 3–4 for ease and clarity of description.

As shown, the adapter insert 28 is mounted onto the upper end of the shaft 14 in the same manner as previously described, and the adapter socket 32 is mounted in the same manner as previously described within the lower end of a tubular hand grip segment 20 having the hand grip 22 of selected diametric size and tread pattern, etc., mounted thereon. The compression nut 44 is threaded onto the male thread 48 on the adapter socket 32 for tightly drawing and retaining the thrust flange 40 seated on the thrust seat 42. With the thrust flange 40 seated and retained in this manner, the nose end of the adapter insert 28 including the pin 56 engages and partially compresses the bushing 52 mounted at a base end of the adapter socket 32 to provide the desired stable two-point connection. In this regard, an uppermost end of the socket member 34 mounted within the hand grip segment 20 may be turned radially inwardly to define a backstop support lip 96 as shown in FIG. 17 to support and retain the bushing 52 in place. Alternately, the base end of the socket member 34 may have a cup-shaped configuration defining a base wall (not shown) in lieu of the support lip 96.

Alternative forms of the above described shaft-hand grip segment connection 18 will be apparent to persons skilled in the art. Specifically, any of the above described shaft-head connections may be used, including any combination of the disclosed means for providing a stable two-point connection including retention of the thrust flange on the thrust seat, and engagement of the adapter insert nose end or tip with the compliant anchor member.

A variety of further modifications and improvements in and to the improved temporary shaft-component connection for a golf club of the present invention will be apparent to those persons skilled in the art. For example, while the invention is shown and described with respect to a nonmetallic club shaft 14, it will be recognized and appreciated that the invention may be utilized with a metal club shaft. Accordingly, no limitation on the invention is intended by way of the foregoing description and accompanying drawings, except as set forth in the appended claims.

What is claimed is:

1. A temporary connection for connecting a golf club shaft with an additional club component, said temporary connection comprising:

an elongated adapter insert defining a thrust flange;

an adapter socket having a size and shape for slide-fit reception of said adapter insert, said adapter socket defining a thrust seat for substantially seated reception of said thrust flange when said adapter insert is slidably received into said adapter socket, said adapter insert and socket further including interengageable surfaces for substantially preventing relative rotation therebetween when said adapter insert is slidably received into said adapter socket;

first connection means for removably interconnecting said adapter insert and socket with said thrust flange seated upon said thrust seat; and second connection means including a resilient anchor member interposed between said adapter insert and socket at a position spaced axially from said thrust flange and said thrust seat, said anchor member being at least partially compressed when said thrust flange is seated upon said thrust seat for substantially constraining said adapter insert and socket against relative movement.

2. The temporary connection of claim 1 wherein the additional club component comprises a golf club head having a hosel, and further wherein said adapter socket is on said hosel, and said adapter insert is on said club shaft.

3. The temporary connection of claim 1 wherein the additional component comprises a golf club hand grip segment, one of said adapter insert and said adapter socket being on said club shaft, and the other of said adapter insert and said adapter socket being on said hand grip segment.

4. The temporary connection of claim 3 wherein said adapter insert is on said club shaft, and said adapter socket is on said hand grip segment.

5. The temporary connection of claim 1 wherein said interengageable surfaces comprise an external spline segment on said adapter insert, and an internal spline segment within said adapter socket.

6. The temporary connection of claim 1 wherein said first connection means comprises a compression nut carried by one of said adapter insert and socket and defining an internal thread and an internal thrust shoulder, and an external thread formed on the other of said adapter insert and socket, said compression nut being threadably engageable with said external thread for urging said thrust shoulder against one of said thrust flange and thrust seat for axially displacing said thrust flange into seated engagement upon said thrust seat.

7. The temporary connection of claim 6 wherein said compression nut is carried by said adapter insert, and said external thread is formed on said adapter socket.

8. The temporary connection of claim 6 further including a backstop reaction member on said one of said adapter insert and socket, said backstop reaction member being engageable by said compression nut upon unthreading thereof from said external thread for axially separating said adapter insert from said adapter socket.

9. The temporary connection of claim 1 wherein said first connection means comprises a lock pin removably fastened through said adapter insert and socket when said thrust flange is seated upon said thrust seat.

10. The temporary connection of claim 1 wherein said first connection means comprises a snap ring removably mounted onto said adapter insert and socket when said thrust flange is seated upon said thrust seat.

11. The temporary connection of claim 1 wherein said first connection means comprises a quick-connect-disconnect assembly for locking said adapter insert and socket against relative axial displacement when said thrust flange is seated upon said thrust seat.

12. The temporary connection of claim 1 wherein said first connection means comprises a lock bolt threadably connected to said adapter insert for drawing and retaining said thrust flange in seated engagement upon said thrust seat.

13. The temporary connection of claim 1 wherein said anchor member substantially constrains said adapter insert against axial displacement relative to said adapter socket.

14. The temporary connection of claim 1 wherein said anchor member substantially constrains said adapter insert against rotational displacement relative to said adapter socket.

15. The temporary connection of claim 1 wherein said anchor member substantially constrains said adapter insert against axial and rotational displacement relative to said adapter socket.

16. The temporary connection of claim 1 wherein said anchor member comprises a generally cylindrical bushing seated within a base end of said adapter socket, and wherein said adapter insert includes a nose end defining a tip for press-fit reception into said bushing and a bearing shoulder for axially bearing against said bushing, when said thrust flange is seated upon said thrust seat.

17. The temporary connection of claim 1 wherein said anchor member is axially spaced from said thrust flange and said thrust seat by at least about 1 to 2 inches, when said thrust flange is seated upon said thrust seat.

18. The temporary connection of claim 1 further including a reinforcement plug carried within said adapter insert.

19. A temporary connection for connecting a golf club shaft with an additional club component, said temporary connection comprising:

an elongated adapter insert defining a thrust flange;

an adapter socket having a size and shape for slide-fit reception of said adapter insert, said adapter socket defining a thrust seat for substantially seated reception of said thrust flange when said adapter insert is slidably received into said adapter socket, said adapter insert and socket further including interengageable surfaces for substantially preventing relative rotation therebetween when said adapter insert is slidably received into said adapter socket;

first connection means for removably interconnecting said adapter insert and socket with said thrust flange seated upon said thrust seat, said first connection means including a compression nut carried by one of said adapter insert and socket and defining an internal thread and an internal thrust shoulder, and an external thread formed on the other of said adapter insert and socket, said compression nut being threadably engageable with said external thread for urging said thrust shoulder against one of said thrust flange and thrust seat for axially displacing said thrust flange into seated engagement upon said thrust seat; and second connection means including a resilient anchor member seated within a base end of said adapter socket and interposed between said adapter insert and socket at a position spaced axially from said thrust flange and said thrust seat, said anchor member being at least partially compressed when said thrust flange is seated upon said thrust seat for substantially constraining said adapter insert and socket against relative movement.

20. A golf club, comprising:

an elongated golf club shaft having a lower end;

an elongated adapter insert carried by said club shaft at said club shaft lower end;

a thrust flange carried by said club shaft at a position generally adjacent to said club shaft lower end;

a club head having a hosel;

an adapter socket carried by said hosel and having a size and shape for slide-fit reception of said adapter insert, said adapter socket defining a thrust seat for substantially seated reception of said thrust flange when said adapter insert is slidably received into said adapter socket, said adapter insert and socket further including interengageable surfaces for substantially preventing relative rotation therebetween when said adapter insert is slidably received into said adapter socket;

first connection means for removably interconnecting said adapter insert and socket with said thrust flange retained in axially seated relation upon said thrust seat; and second connection means including a resilient anchor member interposed between said adapter insert and socket at a position spaced axially from said thrust flange and said thrust seat, said anchor member being at least partially compressed when said thrust flange is seated upon said thrust seat for substantially constraining said adapter insert and socket against relative movement.

21. The golf club of claim 20 wherein said interengageable surfaces comprise an external spline segment on said adapter insert, and an internal spline segment within said adapter socket.

22. The golf club of claim 20 wherein said first connection means comprises a compression nut carried by one of said adapter insert and socket and defining an internal thread and an internal thrust shoulder, and an external thread formed on the other of said adapter insert and socket, said compression nut being threadably engageable with said external thread for urging said thrust shoulder against one of said thrust flange and thrust seat for axially displacing said thrust flange into seated engagement upon said thrust seat.

23. The golf club of claim 22 wherein said compression nut is carried by said adapter insert, and said external thread is formed on said adapter socket.

24. The golf club of claim 22 further including a backstop reaction member on said one of said adapter insert and socket, said backstop reaction member being engageable by said compression nut upon unthreading thereof from said external thread for axially separating said adapter insert from said adapter socket.

25. The golf club of claim 20 wherein said anchor member substantially constrains said adapter insert against axial and rotational displacement relative to said adapter socket.

26. A golf club, comprising:

an elongated golf club shaft having an upper end;

an elongated adapter insert carried by said club shaft at said club shaft upper end;

a thrust flange carried by said club shaft at a position generally adjacent to said club shaft upper end;

a hand grip segment;

an adapter socket carried by said hand grip segment and having a size and shape for slide-fit reception of said adapter insert, said adapter socket defining a thrust seat for substantially seated reception of said thrust flange when said adapter insert is slidably received into said adapter socket, said adapter insert and socket further including interengageable surfaces for substantially preventing relative rotation therebetween when said adapter insert is slidably received into said adapter socket;

first connection means for removably interconnecting said adapter insert and socket with said thrust flange retained in axially seated relation upon said thrust seat; and second connection means including a resilient anchor member interposed between said adapter insert and socket at a position spaced axially from said thrust flange and said thrust seat, said anchor member being at least partially compressed when said thrust flange is seated upon said thrust seat for substantially constraining said adapter insert and socket against relative movement.

27. The golf club of claim 26 wherein said first connection means comprises a compression nut carried by one of said adapter insert and socket and defining an internal thread and an internal thrust shoulder, and an external thread formed on the other of said adapter insert and socket, said compression nut being threadably engageable with said external thread for urging said thrust shoulder against one of said thrust flange and thrust seat for axially displacing said thrust flange into seated engagement upon said thrust seat.

28. The golf club of claim 27 wherein said compression nut is carried by said adapter insert, and said external thread is formed on said adapter socket.

* * * * *